United States Patent [19]

Nevin

[11] Patent Number: 4,484,998

[45] Date of Patent: Nov. 27, 1984

[54] ELECTROLYTIC CELL

[75] Inventor: Morris N. Nevin, Frodsham, England

[73] Assignee: Imperial Chemical Industries PLC, Hertforshire, England

[21] Appl. No.: 549,445

[22] Filed: Nov. 7, 1983

[30] Foreign Application Priority Data

Nov. 19, 1982 [GB] United Kingdom ..... 8233022

[51] Int. Cl.[3] ..... C25B 9/00; C25B 15/08

[52] U.S. Cl. ..... 204/257; 204/263; 204/279

[58] Field of Search ..... 204/255–258, 204/279, 263

[56] References Cited

U.S. PATENT DOCUMENTS 4,252,628 2/1981 Boulton et al. ..... 204/257

4,371,433 2/1983 Balko et al. ..... 204/255 X 4,402,809 9/1983 Dilmore et al. ..... 204/255 X 4,415,424 11/1983 Pere ..... 204/257

*Primary Examiner*—Donald R. Valentine

*Attorney, Agent, or Firm*—Cushman, Darby & Cushman

[57] ABSTRACT

An electrolytic cell of the filter press type comprising a plurality of anodes and cathodes arranged in an alternating manner, a separator positioned between each adjacent anode and cathode to form in the cell a plurality of anode and cathode compartments, and a header for electrolyte which header is connected by means of passageways to each of the anode compartments of the electrolytic cell, in which each passageway comprises a device which is so shaped that in use it creates a vortex flow in the electrolyte flowing from the header to the anode compartments of the cell.

11 Claims, 7 Drawing Figures

ELECTROLYTIC CELL

Figure 1:
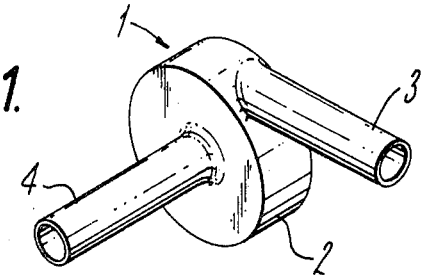

This invention relates to an electrolytic cell and in particular to an electrolytic cell of the filter press type.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other fluids to the cell, suitably from a common header.

In such electrolytic cells the separator may be a porous hydraulically permeable diaphragm or it may be a substantially hydraulically impermeable ionically permselective membrane, e.g. a cation permselective membrane.

Electrolytic cells of the filter press type may comprise a large number of alternating anodes and cathodes, for example, fifty anodes alternatively with fifty cathodes, although the cell may comprise even more anodes and cathodes, for example up to one hundred and fifty alternating anodes and cathodes.

In recent years electrolytic cells of the filter press type have been developed for use in the production of chorine and aqueous alkali metal hydroxide solution by the electrolysis of aqueous alkali metal chloride solution. Where aqueous alkali metal chloride solution is electrolysed in an electrolytic cell of the diaphragm type solution is charged to the anode compartments of the cell, chlorine produced by electrolysis is removed from the anode compartments, depleted solution passes through the diaphragms to the cathode compartments of the cell, and hydrogen and alkali metal hydroxide produced by reaction of alkali metal ions with water, are removed from the cathode compartments, the alkali metal hydroxide being in the form of an aqueous solution which also contains alkali metal chloride.

Where aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with water are removed from the cathode compartments of the cell.

In such electrolytic cells of the filter press type the electrolyte may be charged from a common header to the individual anode compartments of the cell, and the products of electrolysis may be removed from the individual anode and cathode compartments of the cell by feeding the products to common headers. The means of charging the electrolyte and removing the products of electrolysis may be separate pipes leading from separate common headers to each anode and cathode compartment of the electrolytic cell. Alternatively, the electrolytic cell may be formed from a plurality of anode plates, cathode plates and gaskets positioned between each anode and cathode plate, and the gaskets, and optionally the anode and cathode plates, may comprise a plurality of openings therein which in the cell together form a plurality of channels lengthwise of the cell which serve as the headers. In such a cell the means of charging the electrolyte and removing the products of electrolysis may be passageways in the walls of the gaskets and/or of the anode or cathode plates which connect the headers to the anode and cathode compartments of the electrolytic cell. Electrolytic cells of this latter type are described for example in British Pat. Nos. 1595193 and 1595183 which relate respectively to electrolytic cells of the diaphragm type and membrane type.

In electrolytic cells, and particularly in electrolytic cells of the filter press type comprising a large number of individual anode and cathode compartments, it is very desirable that the rate of flow of electrolyte should be substantially the same to each of the anode compartments, that is that there should be an even distribution of electrolyte from the common header to the anode compartments. If there are different rates of flow of electrolyte from the header to the anode compartments the average concentration of electrolyte and the temperature of the electrolyte may vary from anode compartment to anode compartment, with consequent adverse effect on the efficiency of operation of the electrolytic cell. In order to ensure that there is an even distribution of electrolyte between the anode compartments it is necessary to ensure that there is a substantial pressure drop between the common header and the anode compartments. In order to provide for such a substantial pressure drop it may be necessary to provide pipes or passageways of very small cross-section between the common header and the anode compartments. This is particularly the case where the electrolytic cell, and thus the anode compartments, are of relatively small dimensions. The use in the electrolytic cell of such pipes or passageways of small cross-section results in further problems in that each such pipe or passageway must be of substantially the same dimensions and must be constructed to very fine tolerances, and furthermore the pipes or passageways may become partially or even completely blocked, for example by solid materials which may be present in the electrolyte.

The present invention relates to an electrolytic cell in which the aforementioned problems are substantially overcome, and which in use provides an even distribution of electrolyte from a common header to the anode compartments of the cell.

The present invention provides an electrolytic cell of the filter press type comprising

- a plurality of anodes and cathodes arranged in an alternating manner,
- a separator positioned between each adjacent anode and cathode to form in the cell a plurality of anode and cathode compartments, and
- a header for electrolyte which header is connected by means of passageways to each of the anode compartments of the electrolytic cell,
- characterised in that each passageway comprises a device which is so shaped that in use it creates a vortex flow in the electrolyte flowing from the header to the anode compartments of the cell.

Use of a device which is so shaped that it creates a vortex flow in the electrolyte flowing from the header to the anode compartments of the electrolytic cell results in a substantial pressure drop between the header and the anode compartments of the electrolytic cell. In particular, it enables a passageway to be used which has a cross-section of dimensions substantially greater than would be required in a passageway of simple construction, for example a tubular, passageway, in order to produce substantially the same pressure drop. Consequently, use of a device which is so shaped that it creates vortex flow is less susceptible to blockage by solid materials in the electrolyte than is a passageway of simple construction, for example a tubular, passageway, and it need not be constructed to such fine tolerances. Use of such a device also provides increased scope for making dimensional changes in order to achieve the desired pressure drop between the common header and the anode compartments of the electrolytic cell.

A device, hereinafter referred to as a vortex device, which is so shaped that in use it creates a vortex flow may have a variety of different forms.

For example, it may be in the form of a pipe having positioned within the pipe a plurality of vanes which are so shaped and positioned as to create a vortex in the electrolyte flowing through the pipe.

Alternatively, the vortex device may comprise a pipe having a plurality of discs therein positioned transverse to the axis of the pipe. A first disc may have an orifice, or a plurality of orifices, therein positioned near to the wall of the pipe, the orifice(s) being associated with a vane or vanes which create a vortex in the electrolyte flowing through the orifice(s). A second disc positioned downstream of the first disc may have an orifice positioned substantially axially. A series of such discs may be arranged in sequence with a disc with an axial orifice being positioned between a pair of discs with an orifice or orifices near to the wall of the pipe.

A further and preferred type of vortex device comprises a cylindrical body having one or more tangential entry ports, for example, one or more tangentially positioned entry pipes, and an axial exit port for example, an axially positioned exit pipe. In its simplest form this type of device comprises a single tangential entry port. The entry and exit ports, e.g. pipes, of this type of vortex device may be of relatively large cross-section, and in particular of substantially larger cross-section than would be required in for example simple tubular passageways in order to produce substantially the same pressure drop between the common header and the anode compartments of the electrolytic cell.

The preferred vortex device comprises a cylindrical body having a tangential entry port or ports and an axial exit port. Within the scope of the term "tangential" we include the provision of an entry port or ports which are positioned substantially, but not precisely, tangentially in the cylindrical body. Also, within the scope of the term "axial" we include the provision of an exit port which is positioned substantially, but not precisely, axially in the body.

The entry and exit ports, e.g. pipes, of this preferred vortex device will generally be cylindrical in cross-section, and the vortex device is positioned between the common header and the anode compartments of the electrolytic cell in such a way that in use electrolyte flows from the common header into the vortex device via the tangential entry port(s) and from the vortex device via the axial exit port into the anode compartment of the cell.

In order that use of this preferred vortex device should result in a substantial pressure drop it is preferred that the diameter of the cylindrical body be at least three times greater than the diameter of the exit port. No particular advantage is obtained by use of a vortex device in which the diameter of the cylindrical body is more than seven times greater than the diameter of the exit port.

The entry and exit ports of the vortex device may be of substantially the same diameters.

In an electrolytic cell it is found that in order to obtain a given pressure drop between a common header and an anode compartment the preferred vortex device may be used which has an exit port diameter which is about twice the diameter of that of a simple tubular passageway positioned between the header and the anode compartment, that is the cross-sectional area of the exit port of the vortex device may be about four times that of a simple tubular passageway, with consequently a much reduced chance of blockage occurring. The length of the exit pipe has little if any effect on pressure drop.

If desired more than one vortex device may be positioned in series between the common header and each anode compartment of the electrolytic cell in which case, for a given pressure drop, the dimensions of each vortex device, e.g. the dimensions of the entry and exit ports of the devices, may be greater than the dimensions which would be required in the case where only one vortex device is used.

The vortex device should be constructed of a material resistant to the electrolyte and to the products of electrolysis. It may be constructed for example of a corrosion resistant plastics material, e.g. a fluoropolymer, or a corrosion resistant metal, for example a film-forming metal, e.g. titanium.

In the electrolytic cell the separator may be a hydraulically permeable diaphragm or a substantially hydraulically impermeable ionically permselective membrane, e.g. a cation permselective membrane.

The choice of the material of construction of the separator will depend in part on the nature of the electrolyte, and thus on the products of electrolysis. Where an aqueous solution of alkali metal chloride, for example sodium chloride, is to be electrolysed the separator should be resistant to the corrosive products of electrolysis, that is chlorine and alkali metal hydroxide, for example sodium hydroxide.

Where the separator is a hydraulically permeable diaphragm it may be made of a fluorine-containing polymeric material on account of the generally stable nature of such materials in the corrosive environment encountered in many electrolytic cells. Suitable fluorine-containing polymeric materials include, for example, polychlorotrifluoroethylene, fluorinated ethylene-propylene copolymer, and polyhexafluoropropylene. A preferred fluorine-containing polymeric material is polytetrafluoroethylene on account of its great stability in corrosive electrolytic cell environments, particularly in electrolytic cells for the production of chlorine and alkali metal hydroxide by the electrolysis of aqueous alkali metal chloride solutions. Such hydraulically permeable diaphragms are known in the art.

Hydraulically impermeable cation permselective membranes are known in the art and are preferably fluorine-containing polymeric materials containing anionic groups. The polymeric materials preferably are fluoro-carbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from $$[OCF_2-\overset{\overset{A}{|}}{\underset{\underset{Z}{|}}{CF}}]_p \text{ or } A$$

where p has the value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or —COOH. $SO_3H$ group-containing ion exchange membranes are sold under the tradename 'Nafion' by E I DuPont de Nemours and Co Inc and —COOH group-containing ion exchange membranes under the tradename 'Flemion' by the Asahi Glass Co Ltd.

The electrolytic cell may comprise a plurality of gaskets of electrically insulating material which electrically insulate each anode from the adjacent cathodes. The gasket is desirably flexible and preferably resilient and it should be resistant to the electrolyte and to the products of electrolysis. The gasket may be made of an organic polymer, for example a polyofefin, e.g. polyethylene or polypropylene; a hydrocarbon elastomer, e.g. an elastomer based on ethylene-propylene copolymers or ethylene-propylenediene copolymers, natural rubber, or styrene-butadiene rubber; or a chlorinated hydrocarbon, e.g. polyvinyl chloride or polyvinylidene chloride. In an electrolytic cell for the electrolysis of aqueous alkali metal chloride solution the material of the gasket may be a fluorinated polymeric material, for example polytetrafluoroethylene, polyvinyl fluoride, polyvinylidene fluoride, or a tetrafluoroethylene-hexafluoropropylene copolymer, or a substrate having an outer layer of such a fluorinated polymeric material.

In the case where it is desirable or necessary to feed a liquid, e.g. water, to the cathode compartments of the electrolytic cell, for example as in a cell equipped with ion-exchange membranes, the cell may comprise a header connected by means of passageways to each of the cathode compartments of the cell. Each of these passageways may comprise a vortex device in order to provide a pressure drop between the header or headers and the cathode compartments. The products of electrolysis may be fed to a common header through separate passageways. In this case it is not necessary for the passageways to comprise vortex devices.

In the electrolytic cell the passageways by means of which a common header is connected to each anode compartment, and by means of which a common header is connected to each cathode compartment, may be provided by separate pipes leading from a header to each of the anode compartments, and by separate pipes leading from the header to each of the cathode compartments. Those passageways which lead to the anode compartments each comprise a vortex device, and those passageways leading to the cathode compartments may optionally each comprise a vortex device.

In a preferred embodiment the electrolytic cell does not comprise such separate pipes, the cell is formed from a plurality of alternating anode plates, cathode plates and gaskets, with a separator being positioned between each adjacent anode plate and cathode plate, and the gaskets may comprise a plurality of openings which in the cell together form a plurality of channels lengthwise of the cell which serve as the headers. In the electrolytic cell the anode plates and cathode plates may be positioned in recesses in the gaskets, or alternatively the anode plates and cathode plates may also comprise a plurality of openings which in the cell form a part of the channels lengthwise of the cell which serve as headers. In the electrolytic cell the passageways through which the electrolyte may be charged to the anode compartments of the cell may be provided by passageways in the walls of the gaskets, or in the walls of the anode plates, each of these passageways incorporating a vortex device. In the case where it is necessary to feed a liquid e.g. water, to the cathode compartments of the cell, for example as in a cell equipped with permselective membranes, a lengthwise channel may similarly be provided by openings in the gaskets and optionally in the anode and cathode plates which serves a a header, and the cell may be provided with passageways in the walls of the gaskets, or in the walls of the cathode plates, through which liquid may be charged to the cathode compartments from the lengthwise channel. These passageways may each incorporate a vortex device in order to provide a pressure drop between the header and the cathode compartments. The electrolytic cell may also comprise headers formed in a similar manner to which the products of electrolysis may be fed from the anode and cathode compartments of the cell, although in this case it is not necessary for the passageways to incorporate vortex devices.

In the preferred embodiments of the electrolytic cell the gasket may comprise a central opening defined by a frame-like section, which in the cell defines a part of the anode compartment or cathode compartment, and openings in the frame-like section which in the cell form a part of the lengthwise channels which form the headers.

The anode may be metallic and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode will have a central anode portion and, where it comprises openings which in the cell form a part of the lengthwise channels which form the headers these openings will be in a position corresponding to the positions of the openings in the gaskets.

The anode portion may comprise a plurality of elongated members, which are preferably vertically disposed, for example in the form of louvres or strips, or it may comprise a foraminate surface such as mesh, expanded metal or a perforated surface. The anode portion may comprise a pair of foraminate surfaces disposed substantially parallel to each other.

The anode portion of the anode plate may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include platinum itself and those based on ruthenium dioxide/titanium dioxide, ruthenium dioxide/tin dioxide, and ruthenium dioxide/tin dioxide/titanium dioxide.

Such coatings, and methods of application thereof, are well known in the art.

The cathode may be metallic and the nature of the metal will also depend on the nature of the electrolyte to be electrolysed in the electrolytic cell. Where an aqueous solution of an alkali metal chloride is to be electrolysed the cathode may be made, for example of, steel, copper, nickel or copper, or nickel-coated steel.

The cathode will have a central cathode portion and, where it comprises openings which in the cell form a part of the lengthwise channels which form the headers these openings will be in a position corresponding to the positions of the openings in the gaskets.

The cathode portion may comprise a plurality of elongated members, which are preferably vertically disposed, for example in the form of louvers or strips, or it may comprise a foraminate surface such as mesh, expanded metal or perforated surface. The cathode portion may comprise a pair of foraminate surfaces disposed substantially parallel to each other.

The cathode portion of the cathode plate may carry a coating of a material which reduces the hydrogen overvoltage at the cathode when the electrolytic cell is used in the electrolysis of an aqueous solution, e.g. an aqueous alkali metal choride solution. Such coatings are known in the art.

The anodes and cathodes are provided with means for attachment to a power source. For example, they may be provided with extensions which are suitable for attachment to appropriate bus-bars.

It is desirable that both the anodes and cathodes are flexible, and preferably that they are resilient, as flexibility and resiliency assists in the production of leak-tight seals when they are assembled into an electrolytic cell.

The thickness of the anodes and cathodes, is suitably in the range 0.5 mm to 3 mm.

The electrolytic cell may be a monopolar or a bipolar cell. In the case of a monopolar cell it is preferred that the dimensions of the anodes and cathodes in the direction of current flow are such as to provide short current paths which in turn ensure low voltage drops in the anodes and cathodes without the use of elaborate current carrying devices. A preferred dimension in the direction of current flow is in the range 15 to 60 cm.

Where the anodes and cathodes comprise openings which in the electrolytic cell form a part of the lengthwise channels forming the headers it is necessary to ensure that the lengthwise channels which are in communication with the anode compartments of the cell are insulated electrically from the lengthwise channels which are in communication with the cathode compartments of the cell. This electrical insulation may be achieved by means of frame-like members of electrically insulating material inserted in the openings in the anodes and cathodes which form a part of the lengthwise channels.

Figure 3:
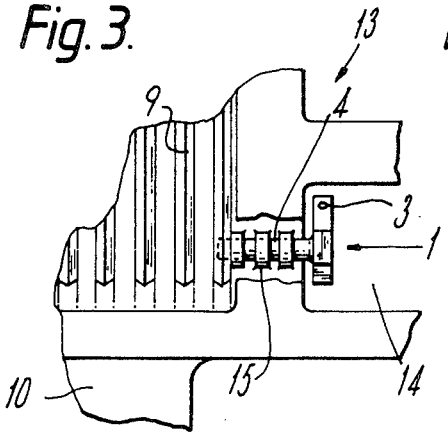
Figure 4:
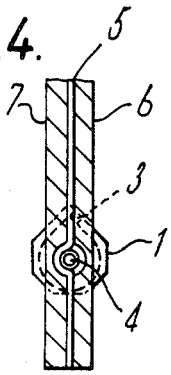
Figure 7:
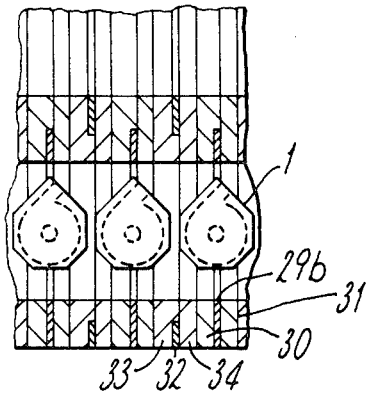
Figure 2:
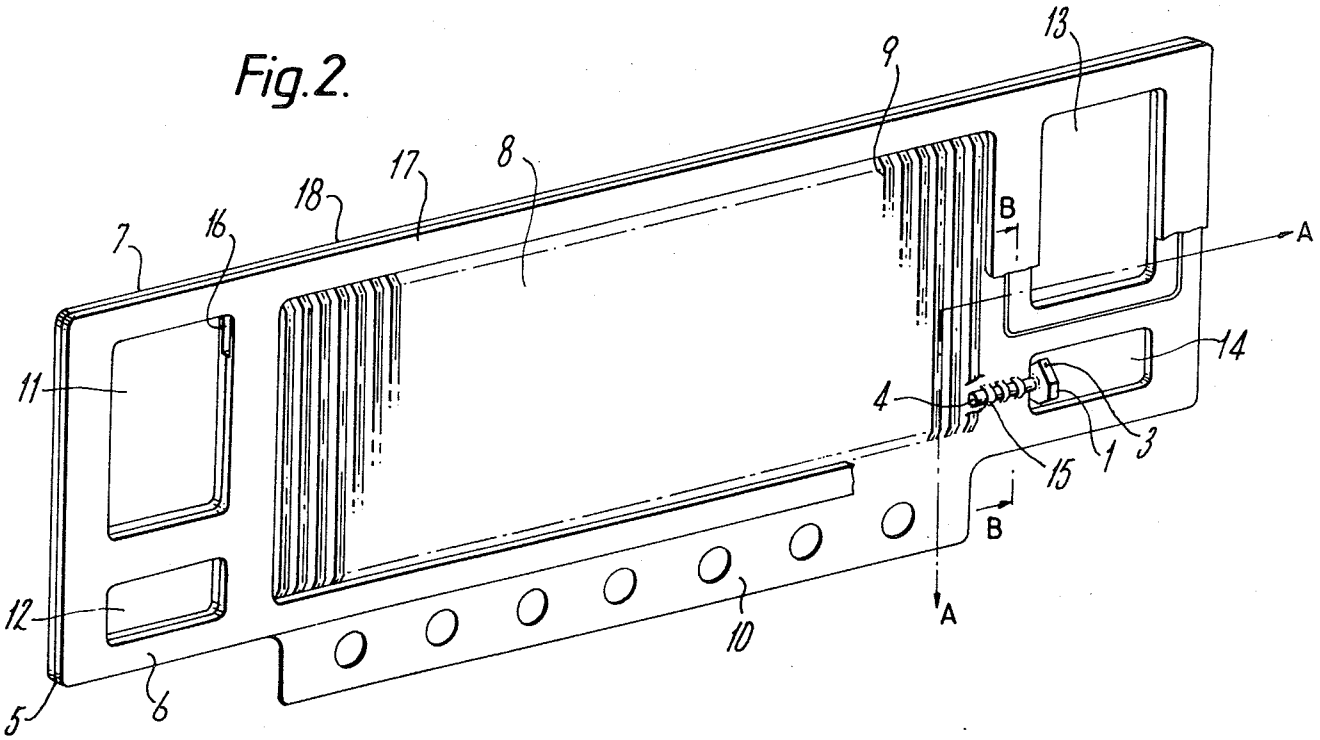
Figure 5:
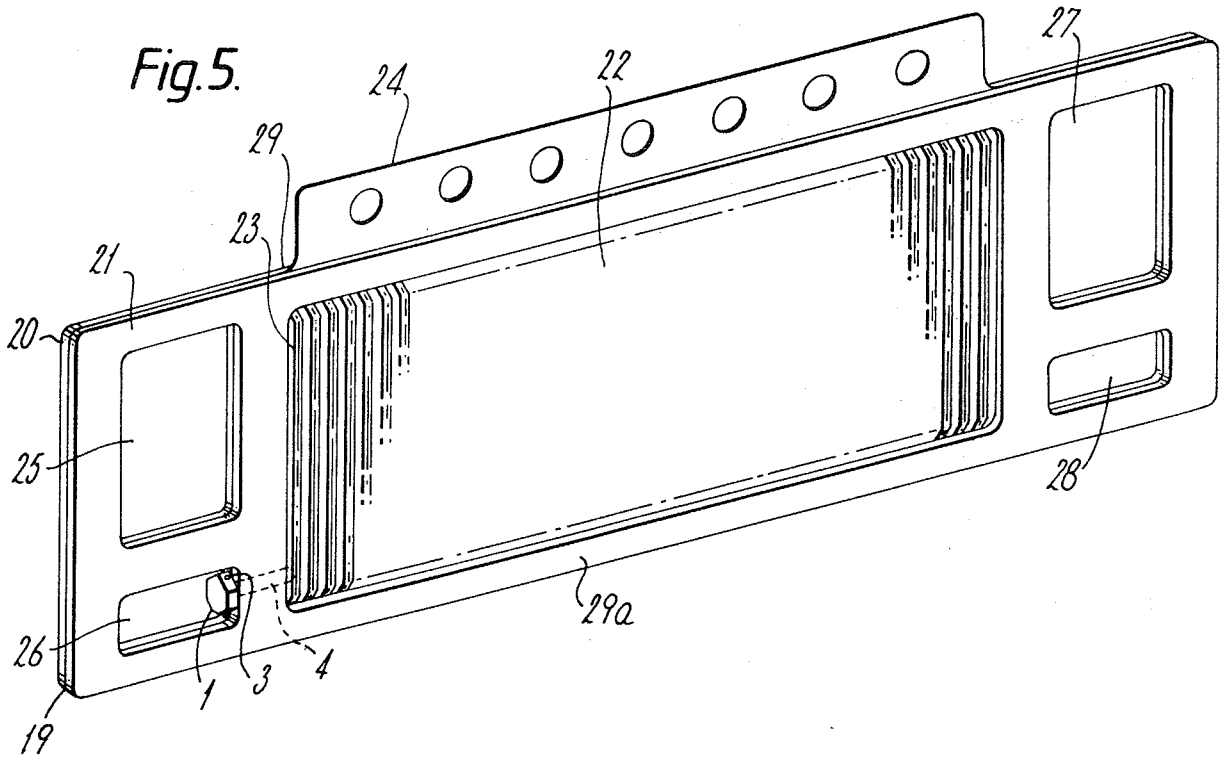
Figure 6:
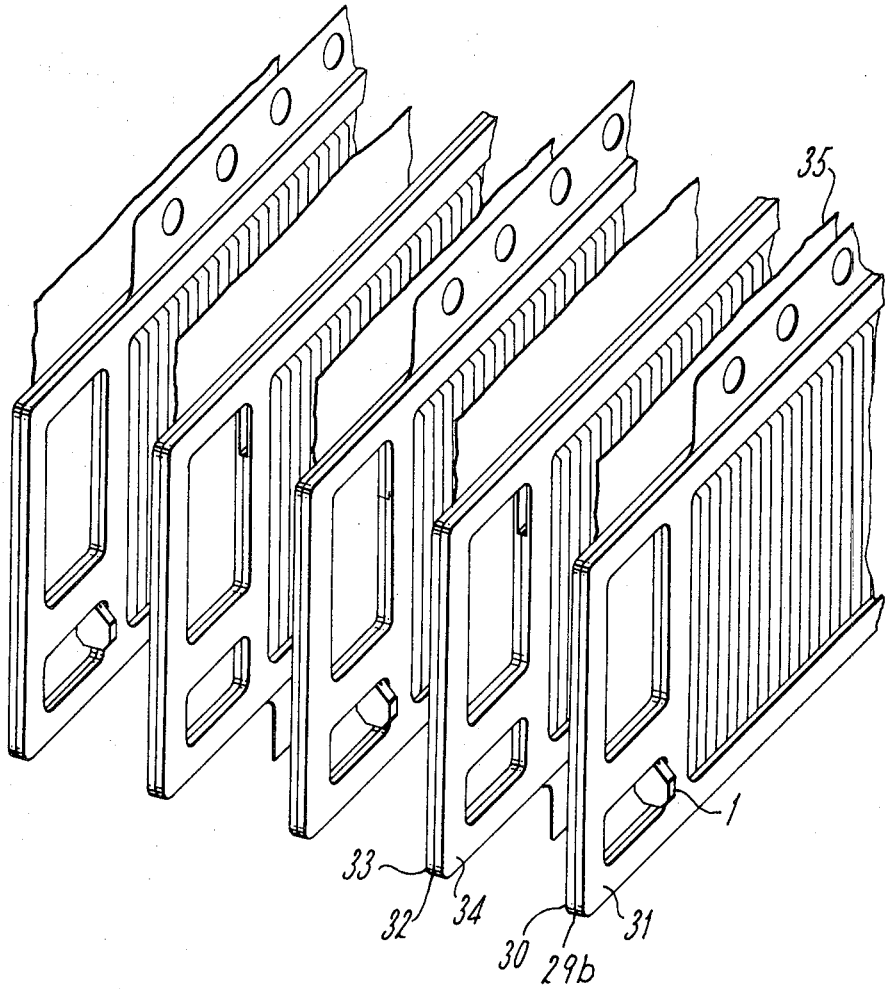

The invention will now be described with reference to the following drawings in which FIG. 1 shows an isometric view of a preferred form of vortex device for use in the electrolytic cell of the invention, FIG. 2 shows an isometric view of an anode and an associated pair of gaskets for use in the electrolytic cell, partially cut away, FIG. 3 shows a view in elevation of a part of the anode of FIG. 2 bounded by the lines A—A, FIG. 4 shows a sectional view of a part of the anode of FIG. 2 along the lines B—B, FIG. 5 shows an isometric view of a cathode and an associated pair of gaskets for use in an electrolytic cell, FIG. 6 shows an exploded isometric view of a part of an electrolytic cell of the invention, and FIG. 7 shows an end sectional view in elevation of a part of the electrolytic cell of FIG. 6.

Referring to FIG. 1 the vortex device (1) comprises a cylindrical body (2), a tangential entry pipe (3) and an axial exit pipe (4).

FIG. 2 shows a metallic anode (5) and a pair of gaskets (6, 7), the gaskets being positioned on either side of the anode (5). The anode (5) comprises frame-like part defining a central opening (8) bridged by a plurality of vertically disposed strips (9) which are attached to the upper and lower parts of the frame-like part and which are parallel to and displaced from the plane of the frame-like part. The strips are positioned on both sides of the frame-like part so that a strip on one side is positioned opposite to the gap between adjacent strips on the other side.

The anode (5) has a metallic projection (10) onto which a suitable electrical connection may be fixed.

The anode comprises in the frame-like part a pair of openings (11, 12) positioned to one side of the central opening (8) and a pair of openings (13, 14) positioned to the opposite side of the central opening (8). When the electrode is installed in an electrolytic cell these openings form a part of compartments (headers) lengthwise of the cell through which electrolyte and other fluid may be charged to the anode and cathode compartments of the cell and through which the products of electrolysis may be removed from the anode and cathode compartments of the cell.

That part of the wall of the anode between the opening (14) and the central opening (8) is slit and parts of the wall (15) are displaced alternately to one side of the anode and to the other side to provide a slot into which the exit pipe (4) of the vortex device (1) is positioned. That part of the wall of the anode between the opening (11) and the central opening (8) is provided with a slot (16) which provides a passageway between the opening (11) and the central opening (8).

The gaskets (6, 7) each comprise a frame-like part (17, 18) and have a central opening in a position corresponding to that of the central opening (8) in the anode (5). The gaskets each comprise a pair of openings in the frame-like part positioned to one side of the central opening and a pair of openings positioned to the opposite side of the central opening, these pairs of openings corresponding in position respectively to the pairs of openings (11, 12) and (13, 14) in the anode (5). The gaskets (6, 7) are made of an electrically insulating material and are provided with lips (not shown) upstanding from the planes of the gaskets in positions corresponding to the positions of the openings (11, 12, 13, 14) in the anode (5) such that when the gaskets (6, 7) are positioned on the anode (5) the lips on adjacent gaskets contact each other and form an electrically insulating layer around the peripheries of the openings (11, 12, 13, 14) in the anode (5).

FIG. 5 shows a metallic cathode (19) and a pair of gaskets (20, 21), the gaskets being positioned on either side of the anode (19). The cathode (19) comprises a frame-like part defining a central opening (22) bridged by a plurality of vertically disposed strips (23) which are attached to the upper and lower parts of the frame-like part and which are parallel to and displaced from the plane of the frame-like part. The strips are positioned on both sides of the frame-like part so that a strip on one side is positioned opposite to the gap between adjacent strips on the other side.

The cathode (19) has a metallic projection (24) onto which a suitable electrical connection may be fixed.

The cathode (19) comprises in the frame-like part and a pair of openings (25, 26) positioned to one side of the central opening (22) and a pair of openings (27, 28) positioned to the opposite side of the central opening (22). When the electrode is installed in an electrolytic cell these openings form a part of compartments (headers) lengthwise of the cell through which electrolyte and other fluid may be charged to the anode and cathode compartments of the cell and through which the products of electrolysis may be removed from the anode and cathode compartments of the cell.

That part of the wall of the cathode (19) between the opening (26) and the central opening (22) is slit and parts of the wall are displaced alternately to one side of the cathode and to the other side to provide a slot (not shown) into which the exit pipe (4) of the vortex device (1) is positioned. That part of the wall of the cathode (19) between the opening (27) and the central opening (22) is provided with a slot (not shown) which provides a passageway between the opening (27) and the central opening (22). The gaskets (20, 21) each comprise a frame-like part (29, 29*a*) and have a central opening in a position corresponding to that of the central opening (22) in the cathode (19). The gaskets each comprise a pair of openings in the frame-like part positioned to one side of the central opening and a pair of openings positioned to the opposite side of the central opening, these pairs of openings corresponding in position respectively to the pairs of openings (25, 26) and (27, 28) in the cathode (19). The gaskets (20, 21) are made of an electrically insulating material and are provided with lips (not shown) upstanding from the planes of the gaskets in positions corresponding to the positions of the openings (25, 26, 27, 28) in the cathode (19) such that when the gaskets (20, 21) are positioned on the cathode (19) the lips on adjacent gaskets contact each other and form an electrically insulating layer around the peripheries of the openings (25, 26, 27, 28) in the cathode (19).

The embodiment of FIG. 6 shows a part of an electrolytic cell of the invention comprising a plurality of cathodes (29*b*) and associated gaskets (30, 31), a plurality of anodes (32) and associated gaskets (33, 34), each of the cathodes (29*b*) having a vortex device (1), and each of the anodes (32) having a vortex device (not shown). A cation-exchange membrane (35) is positioned between each anode (32) and adjacent cathode (29*b*) and is held in position in the assembled electrolytic cell by clamping between the adjacent gaskets, for example between the gasket (30) and the gasket (34).

An anode compartment of the electrolytic cell is formed by that part of the cell bounded by the membranes (35) positioned on either side of an anode (32), and a cathode compartment of the electrolytic cell is formed by that part of the cell bounded by the membranes (35) positioned on either side of a cathode (29*b*).

In use electrolyte, for example aqueous sodium chloride solution, is charged to the anode compartments of the cell via the compartment (header) of which the opening (14) in the anode (5) forms a part and via the vortex device (1). Products of electrolysis, for example, chlorine and diluted aqueous sodium chloride solution, are removed from the anode compartments of the cell via the slot (16) and the compartment (header) of which the opening (11) in the anode (5) forms a part. Fluid, for example water or dilute aqueous sodium hydroxide solution, is charged to the cathode compartments of the cell via the compartment (header) of which the opening (26) in the cathode (19) forms a part and via vortex device (1). Products of electrolysis, for example aqueous sodium hydroxide solution and hydrogen, are removed from the cathode compartments of the cell via a slot (not shown) and the compartment (header) of which the opening (27) in cathode (19) forms a part.

The specific embodiment described relates to an electrolytic cell of the monopolar type. It is to be understood that devices which create a vortex flow may be incorporated into electrolytic cells of the bipolar type which comprise a plurality of electrodes having an anode face and a cathode face and in which a separator is positioned between the anode face of each electrode and the cathode face of the next adjacent electrode thereby dividing the cell into a plurality of anode compartments and cathode compartments.

An electrolytic cell as hereinbefore specifically described was used to electrolyse aqueous sodium chloride solution. The cell was equipped with an ionically permselective membrane of a perfluoropolymer containing carboxylic acid groups (Flemion, Asahi Glass Co. Ltd). Aqueous sodium chloride solution at a concentration of 300 g/l was charged to the anode compartments of the cell, and solution at a concentration of 230 g/l together with chlorine were removed from the anode compartments of the cell. Water was charged to the cathode compartments of the cell and 35 weight % sodium hydroxide solution and hydrogen were removed from the cathode compartments of the cell.

The anodes comprised a coating of 35 weight % $RuO_2$ and 65 weight % $TiO_2$, and nickel cathodes were used. The electrolysis was effected at a temperature of 90° C., a voltage of 3.2 volts, and a current density of 3 $kA/m^2$. Electrolysis proceeded uninterruptedly for 6 months.

Throughout the electrolysis there was found to be a uniform voltage drop along each of copper electrical connections to the anodes indicating that there was a uniform distribution of solution to the anode compartments.

I claim:

1. An electrolytic cell of the filter press type comprising a plurality of anodes and cathodes arranged in an alternating manner, a separator positioned between each adjacent anode and cathode to form in the cell a plurality of anode and cathode compartments, and a header for electrolyte which header is connected by means of passageways to each of the anode compartments of the electrolytic cell, characterised in that each passageway comprises a device which is so shaped that in use it creates a vortex flow in the electrolyte flowing from the header to the anode compartments of the cell.

2. An electrolytic cell as claimed in claim 1 characterised in that the device which creates vortex flow comprises a cylindrical body having one or more tangential entry ports and an axial exit port.

3. An electrolytic cell as claimed in claim 2 characterised in that the device which creates vortex flow comprises a single tangential entry port.

4. An electrolytic cell as claimed in claim 2 or claim 3 characterised in that in the device which creates vortex flow the entry and exit ports comprise pipes.

5. An electrolytic cell as claimed in claim 2 or claim 3 characterised in that in the device which creates vortex flow the diameter of the cylindrical body is at least three times greater than the diameter of the exit port.

6. An electrolytic cell as claimed in claim 2 or claim 3 characterised in that in the device which creates vortex flow the diameter of the cylindrical body is not more than seven times greater than the diameter of the exit port.

7. An electrolytic cell as claimed in any one of claims 1 to 3 characterised in that the separator is a hydraulically impermeable ionically permselective membrane.

8. An electrolytic cell as claimed in any one of claims 1 to 3 in which the electrolytic cell comprises a header connected by means of passageways to each of the cathode compartments of the cell, characterised in that each passageway comprises a device which is so shaped that in use it creates a vortex flow in the liquid flowing from the header to the cathode compartments of the cell.

9. An electrolytic cell as claimed in claim 1 characterised in that the electrolytic cell comprises a plurality of alternating anode plates, cathode plates, and gaskets, and in that the gaskets, and optionally the anode plates and cathode plates, comprise a plurality of openings which in the cell form a plurality of channels lengthwise of the cell which serve as the headers.

10. An electrolytic cell as claimed in claim 9 characterised in that the passageways through which electrolyte may be charged to the anode compartments of the cell are provided by passageways in the walls of the gaskets, or in the walls of the anode plates, each of which passageways incorporates a device which in use creates vortex flow.

11. An electrolytic cell as claimed in claim 9 or claim 10 characterised in that the passageways through which liquid may be charged to the cathode compartments of the cell are provided by passageways in the walls of the gaskets, or in the walls of the cathode plates, each of which passageways incorporates a device which in use creates vortex flow.

* * * * *